US008047532B2

(12) United States Patent
Kobayashi

(10) Patent No.: US 8,047,532 B2
(45) Date of Patent: Nov. 1, 2011

(54) FEED DEVICE AND RECORDING DEVICE

(75) Inventor: Satoshi Kobayashi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/547,703

(22) Filed: Aug. 26, 2009

(65) Prior Publication Data

US 2010/0052236 A1 Mar. 4, 2010

(30) Foreign Application Priority Data

Aug. 27, 2008 (JP) ..... 2008-217991
May 22, 2009 (JP) ..... 2009-124593

(51) Int. Cl.
*B65H 3/52* (2006.01)

(52) U.S. Cl. ..... 271/121; 271/124

(58) Field of Classification Search ..... 271/121, 271/122, 124, 104, 123, 125, 137, 167, 168, 271/169

See application file for complete search history.

(56) References Cited

U.S. PATENT DOCUMENTS 2,705,636 A * 4/1955 La Bombard ..... 271/124
4,535,981 A * 8/1985 Watanabe et al. ..... 271/121
5,707,057 A * 1/1998 Oyama ..... 271/121
7,104,539 B2 * 9/2006 Shimoyama ..... 271/167
7,384,032 B2 * 6/2008 Sata ..... 271/110
2004/0251602 A1 * 12/2004 Ruhe et al. ..... 271/167
2006/0170147 A1 * 8/2006 Sata ..... 271/121

FOREIGN PATENT DOCUMENTS

JP 08-091612 4/1996
JP 2009-001366 1/2009

* cited by examiner

*Primary Examiner* — Stefanos Karmis
*Assistant Examiner* — Thomas Morrison
(74) *Attorney, Agent, or Firm* — Maschoff Gilmore & Israelsen

(57) ABSTRACT

Provided is a feed device including: a loading unit in which a plurality of sheet members is loaded in a stacked state; a delivery member which performs a feed operation in a state in which a contact surface thereof is in contact with an uppermost sheet member of the sheet members loaded on the loading unit and delivers the sheet member in a feed direction using the frictional force with the uppermost sheet member as the feeding force; a gate member which is configured to move in a direction to and or from the contact surface of the delivery member and has an inclined surface with which a front end of the sheet member delivered by the delivery member collides with; and a gate energizing member which energizes the gate member in a direction approaching to the contact surface of the delivery member.

4 Claims, 7 Drawing Sheets

FEED DEVICE AND RECORDING DEVICE

BACKGROUND

1. Technical Field

The present invention relates to a feed device such as a paper feed device and a recording device such as an ink jet printer including the feed device.

2. Related Art

A known recording device such as a printer includes a paper feed device (feed device) for automatically feeding paper to a location facing a recording head (recording unit) while separating a plurality of sheets of paper loaded in a stacked state one by one so as to continuously perform recording with respect to the plurality of sheets of paper (sheet members) (for example, JP-A-8-91612).

The feed device of JP-A-8-91612 includes a paper feed cassette (loading unit) in which a plurality of sheets of paper is loaded in a stacked state, a paper feed roller (delivery member) which rotates in a state of being in contact with uppermost sheet of paper of the sheets of paper loaded in the stacked state and delivers the uppermost sheet in a feed direction by the frictional force with the uppermost paper, and a gate member for preventing double feed of the uppermost sheet of paper and its underlying sheet of paper in the feed direction.

In detail, this gate member is configured such that one end side thereof is supported so as to be able to oscillate as a fulcrum and the other end side thereof is in contact with an outer circumferential surface of the paper feed roller with predetermined pressure by the energizing force of a compression spring. In addition, an inclined surface is provided in the other end side of the gate member at a location where the front end of paper continuously delivered by the paper feed roller may collide therewith. If the front end of the paper delivered by the paper feed roller in the feed direction collides with the inclined surface, the gate member of which the inclined surface is pressed by the paper oscillates against the energizing force of the compression spring in a direction separated from the outer circumferential surface of the paper feed roller and thus a gap through which only a sheet of paper passes is formed between the paper feed roller and the gate member. Accordingly, only the uppermost sheet of paper is fed through the gap in the feed direction. At this time, if the uppermost sheet of paper and its underlying sheet of paper are double fed by the frictional force therebetween, the double feed of the paper underlying the uppermost sheet of paper is prevented by the inclined surface of the gate member.

However, in the paper feed device of JP-A-8-91612, if the frictional force generated between the uppermost sheet of paper and its underlying sheet of paper is increased due to a variation in the surrounding environment (temperature, humidity or the like), the underlying sheet of paper may be double fed over the inclined surface of the gate member when the uppermost sheet of paper is fed.

SUMMARY

An advantage of some aspects of the invention is that it provides a feed device and a recording device capable of efficiently suppressing double feeding of a sheet member underlying an uppermost sheet member when the uppermost sheet member is fed from sheet members loaded in a stacked state.

According to an aspect of the invention, there is provided a feed device including: a loading unit in which a plurality of sheet members is loaded in a stacked state; a delivery member which performs a feed operation in a state in which a contact surface thereof is in contact with an uppermost sheet member of the sheet members loaded on the loading unit and delivers the sheet member in a feed direction using frictional force with the uppermost sheet member as the feeding force; a gate member which is configured to move in a direction to and from the contact surface of the delivery member and has an inclined surface with which a front end of the sheet member delivered by the delivery member collides; and a gate energizing member which energizes the gate member in a direction approaching the contact surface of the delivery member, wherein, in the uppermost sheet member is delivered by the delivery member such that the front end thereof collides with the inclined surface of the gate member, and a gap is formed through which only the uppermost sheet member passes between the delivery member and the gate member by moving the gate member against energizing force of the gate energizing member in the direction separating it from the delivery member, wherein a rotary member is included which is configured so as to be rotated and displaced between a first position and a second position, and wherein, when the rotary member is located at the first position, the energizing force of the gate energizing member is maintained at the same level as the energizing force at the time of collision which is the energizing force of the gate energizing member when the front end of the uppermost sheet member collides with the inclined surface, and, when the rotary member is located at the second position, the rotary member is engaged with the gate energizing member such that the energizing force of the gate energizing member becomes larger than the energizing force at the time of collision.

By this configuration, when the uppermost sheet member of the sheet members loaded in the stacked state is fed, after a portion of the uppermost sheet member passes through the gap, the rotary member is rotated and displaced from the first position to the second position such that the energizing force of the gate energizing member is increased so as to become larger the energizing force at the time of collision. Therefore, since it will be harder for the sheet member underlying the uppermost sheet member to get over the inclined surfaces, it is possible to easily separate the uppermost sheet member and the sheet member underlying the uppermost sheet member. As a result, when the uppermost sheet member is fed, it is possible to efficiently suppress double feeding of the sheet member underlying the uppermost sheet member.

The feed device of the invention, the rotary member may include a first arm which is engaged with the sheet member at a downstream side of the inclined surface on a feed path of the sheet member at the first position and a second arm which applies pressing force to the gate energizing member in a direction, in which the energizing force of the gate energizing member is increased, at the second position.

By this configuration, the rotary member is rotated and displaced from the first position to the second position by the engagement of the uppermost sheet member and the first arm such that the energizing force of the gate energizing member can be increased by the second arm.

In the feed device of the invention, a roller which rotates by the feed of the sheet member may be provided in a contact portion of the first arm with the sheet member. By this configuration, even if the first arm is in contact with the sheet member when the sheet member is fed, the roller which is in contact with the sheet member is rotated such that the frictional resistance force applied to the sheet member from the first arm is reduced. Thus, the sheet member can be smoothly fed.

According to another aspect of the invention, there is provided a recording device including: the feed device according to claim 1; and a recording unit which performs a recording process with respect to the sheet member fed by the feed device.

By this configuration, the same effects as described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as a "printer") which is implemented as a recording device of the invention will be described with reference to the accompanying drawings. In the following description, terms "front-and-rear direction", "left-and-right direction" and "up-and-down direction" respectively indicate directions denoted by arrows of the drawings.

Figure 1:
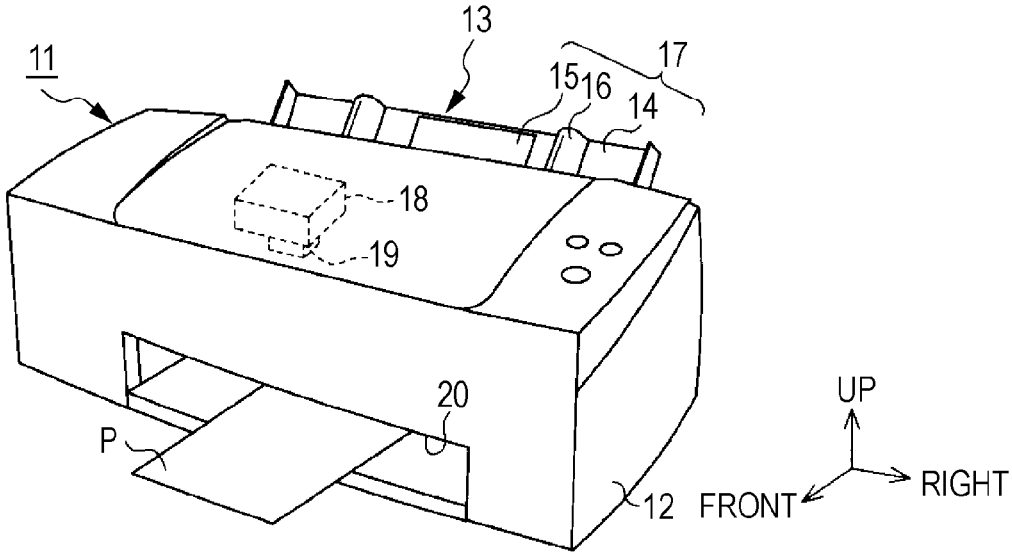
FIG. 1 is a perspective view of an ink jet printer according to an embodiment of the invention.

As shown in FIG. 1, the printer 11 which is the recording device includes a main body 12 having a substantially rectangular parallelepiped shape. An auto paper feed device 13 which functions as a feed device for feeding paper P as a sheet member, is mounted on a rear surface of the main body 12. The auto paper feed device 13 includes a paper guide 17 functioning as a loading unit and having a paper feed tray 14, a hopper 15 and an edge guide 16, and a paper feed driving mechanism (not shown) for feeding one by one a plurality of sheets of paper P loaded in the paper guide 17 in a stacked state into the main body 12.

A carriage 18 which reciprocally moves in the main scan direction (the left-and-right direction of FIG. 1) is provided in the main body 12, and a recording head 19 functioning as a recording unit is provided under the carriage 18. Printing (recording) onto paper P is performed by alternately repeating a recording operation for ejecting ink from the recording head 19 onto paper P while the carriage 18 moves in the main scan direction and a feed operation for feeding the paper P in the sub scan direction (a front direction) in a predetermined feed amount. In addition, the printed paper P is ejected from an ejection port 20 opened in the lower side of the front surface of the main body 12.

Figure 2:
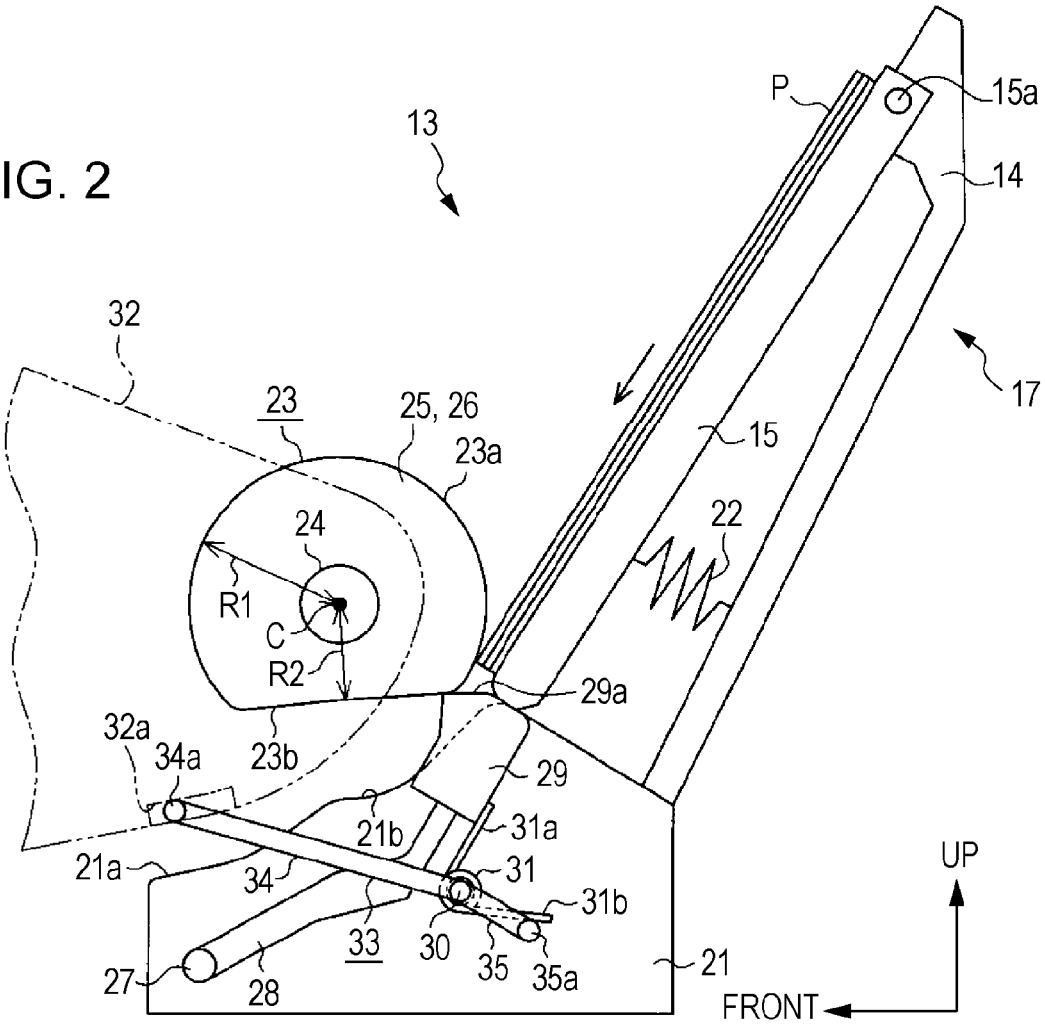
FIG. 2 is a schematic side view showing a state in which a rotary member is located at a first position, in an auto feed device according to the embodiment of the invention.
Figure 3:
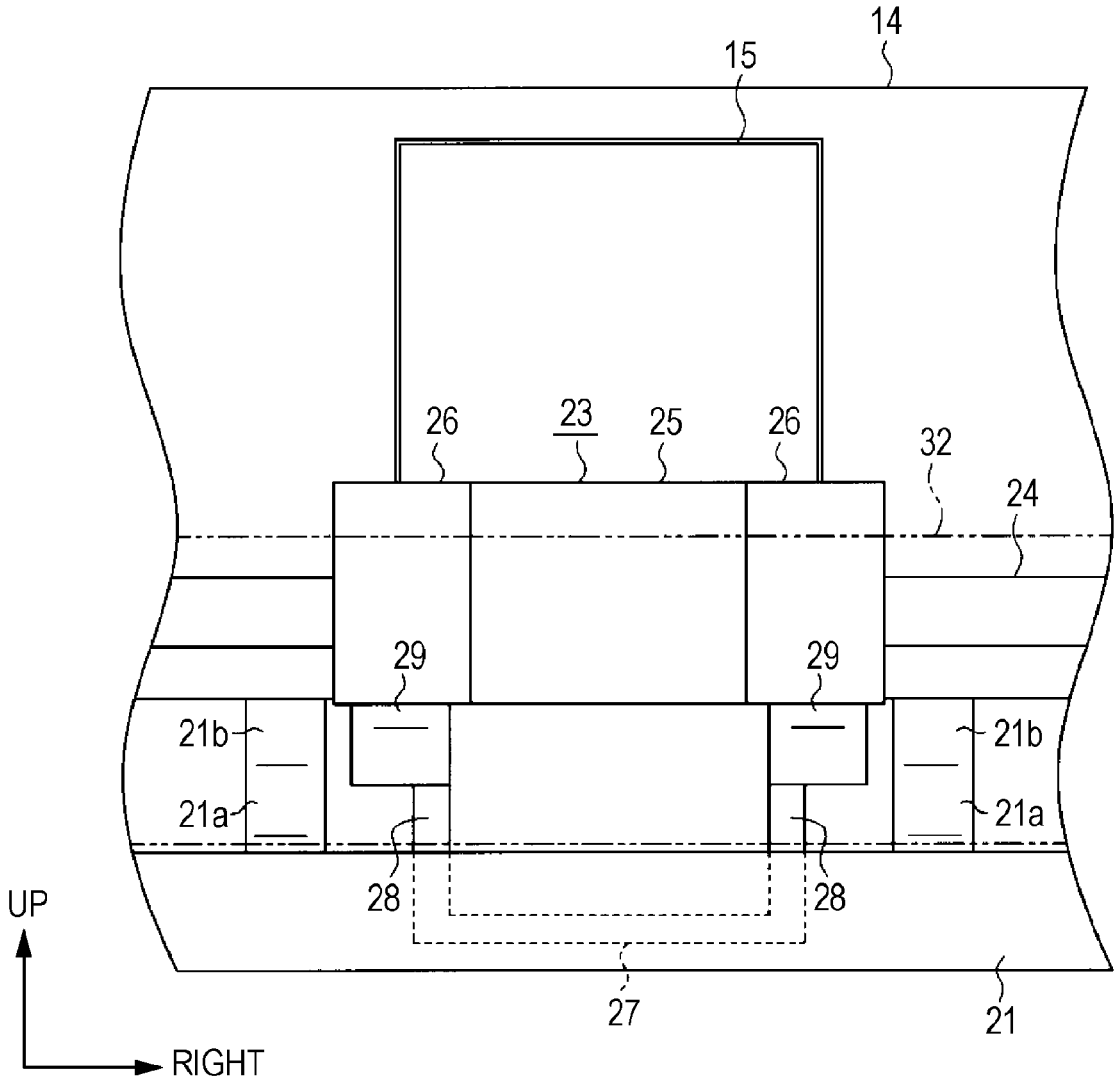
FIG. 3 is a schematic enlarged front view of main portions of the auto feed device according to the embodiment of the invention.

As shown in FIGS. 2 and 3, the lower end side of the paper feed tray 14 obliquely disposed on the rear surface of the main body 12 (see FIG. 1) of the auto paper feed device 13 is supported by the rear side of a base portion 21 disposed in the main body 12, and the hopper 15 is provided on the central portion in the left-and-right direction of the upper surface of the paper feed tray 14. A compression spring 22 is interposed between the hopper 15 and the paper feed tray 14 at a lower end side thereof. The hopper 15 is configured so as to be able to rotate around a shaft 15*a* provided at the upper end side thereof between a paper feed position shown in FIG. 2 and a retreated position (see FIG. 4) in which the compression spring 22 is more compressed than in the state shown in FIG. 2 and the lower end side of the hopper 15 is rotated in a counterclockwise direction. In FIG. 3, for the sake of understanding the drawing, the paper P is not shown.

At the front side in the vicinity of the lower end of the hopper 15 located at the paper feed position, a paper feed roller 23, which functions as a delivery member and has a substantially D-shape in a side view, is supported on a rotary shaft 24 which extends in the left-and-right direction and is provided in the main body 12 (see FIG. 1) so that it is able to rotate. The paper feed roller 23 includes a delivery portion 25 formed by covering an outer circumferential surface of a core made of hard plastic with rubber, and separation portions 26 made of hard plastic and integrally formed on the left and right sides of the delivery portion 25.

The width of the delivery portion 25 in the left-and-right direction is larger than that of the separation portions 26, and the outer circumferential surface of the delivery portion 25 and the outer circumferential surfaces of the separation portions 26 are flush with each other. The paper feed roller 23 is rotated by rotary driving of the rotary shaft 24 so as to perform the feed operation of the paper P. The outer circumferential surface of the paper feed roller 23 includes a circumferential surface 23*a* which is a contact surface having a radius of a distance R1 from an axial center C of the rotary shaft 24 and a flat surface 23*b* separating from the axial center C of the rotary shaft 24 by a distance R2, and the distance R1 is set to be larger than the distance R2.

That is, the distances R1 and R2 are set such that the circumferential surface 23*a* is brought into contact with the paper P and the flat surface 23*b* is not brought into contact with the paper P, when the paper feed roller 23 is rotated in a state in which the hopper 15 is disposed at the paper feed position. In a state in which the circumferential surface 23*a* is brought into contact with the paper P, the paper P is pressed into contact with the circumferential surface 23*a* by the energizing force of the compression spring 22.

The friction force with the paper P, when the paper feed roller 23 is rotated in a state in which the circumferential surface 23*a* of the delivery portion 25 and the paper P are in contact with each other, is set to be larger than the friction force between the stacked sheets of paper P. In contrast, the friction force with the paper P, when the paper feed roller 23 is rotated in a state in which the circumferential surface 23*a* of each of the separation portions 26 and the paper P are in contact with each other, is set to be smaller than the friction force between the stacked sheets of paper P.

Accordingly, when the paper feed roller 23 is rotated in a state of being in contact with the paper P, the energizing force of the compression spring 22 becomes a vertical resisting force and the friction force generated between the circumferential surface 23*a* of the delivery portion 25 and the paper P becomes the feeding force, such that the paper P is delivered by the delivery portion 25. In this case, since the friction force generated between the circumferential surface 23*a* of each of the separation portions 26 and the paper P is smaller than the friction force generated between the sheets of paper P, the feeding force for delivering the paper P is not generated in the separation portions 26.

As shown in FIGS. 2 and 3, guides 21*a* obliquely extending forward and downward are formed on the front side of the base portion 21 at positions which become the outsides of the paper feed roller 23 in the left-and-right direction. A bank 21*b* (see FIG. 2) having a gentle projecting shape in a side view is formed in the vicinity of the center of the front-and-rear direction of each of the guides 21*a*.

Arm members 28, which are supported so that they can oscillate by the base portion 21 with an axial portion 27 whose lower end side extends in the left-and-right direction, are obliquely disposed at positions corresponding to both the separation portions 26 in the insides of both the guides 21*a* in the base portion 21, and gate members 29 are attached to the upper end sides of both the arm members 28 so as to individually correspond to both the separation portions 26. In the gate members 29, inclined surfaces 29*a* are formed which protrude higher than the guides 21*a* in the base portion 21 such that the paper P delivered from the paper feed tray 14 collides therewith at a predetermined angle.

A shaft 30 extending in the left-and-right direction is provided on the rear side of the arm member 28 of the base portion 21, and a torsion coil spring 31 functioning as a gate energizing member is mounted on the shaft 30. One end 31*a* of the torsion coil spring 31 is in contact with a rear surface of the gate members 29 and the other end 31*b* thereof is engaged with a rotary member 33.

The gate members 29 are not in contact with the separation portions 26 when facing the vicinities of the centers of the flat surface 23*b* of the separation portions 26 in the paper feed roller 23, but are rotated in a clockwise direction of FIG. 2 around the axial portion 27 and are in contact with the circumferential surface 23*a* of the separation portions 26 when facing the circumferential surface 23*a* of the separation portions 26. When the gate members 29 are in contact with the circumferential surface 23*a* of the separation portions 26, the torsion coil spring 31 is energized in a direction in which the gate members 29 approach the circumferential surface 23*a* of the separation portions 26.

When the paper P is fed, as shown in FIG. 2, the separation portions 26 of the paper feed roller 23 are brought into contact with the gate members 29 and the hopper 15 is then moved from the retreated position to the paper feed position. When the paper P is delivered in a feed direction denoted by arrow of FIG. 2 by the rotated paper feed roller 23, the front end of the uppermost sheet of paper P collides with the inclined surfaces 29*a* of the gate members 29.

At this time, the gate members 29 are moved from the state of FIG. 2 to positions contacting with the circumferential surface 23*a* of the separation portions 26, but are moved in a direction (the clockwise direction of FIG. 2) separated them from the circumferential surface 23*a* of the separation portions 26 against the energizing force of the torsion coil spring 31 by a distance corresponding to the thickness of the uppermost sheet of paper P, by the pressing force when the uppermost sheet of paper P collides with the inclined surfaces 29*a*. At this time, the energizing force of the torsion coil spring 31 is an energizing force during the collision.

In this case, when the uppermost sheet of paper P delivered by the delivery portion 25 of the paper feed roller 23 collides with the inclined surfaces 29*a*, the contact angle between the inclined surfaces 29*a* and the paper P or the energizing force of the torsion coil spring 31 is set such that a gap is formed through which only a single sheet of paper P can pass between the separation portions 26 of the paper feed roller 23 and the gate members 29.

Meanwhile, the paper P underlying the uppermost sheet of paper P does not have the feeding force capable of moving the gate members 29 against the energizing force of the torsion coil spring 31 when colliding with the inclined surfaces 29*a* of the gate members 29. Accordingly, even when the underlying sheet of paper P is pulled along with the uppermost sheet of paper P delivered by the delivery portion 25 of the paper feed roller 23 by the friction force, the underlying sheet of paper P is prevented from being fed due to collision with the inclined surfaces 29*a* of the gate members 29 and thus is separated from the uppermost sheet of paper P.

As shown in FIG. 2, an overhang portion 32 which overhangs so as to face the base portion 21 and the paper feed roller 23, is provided above the base portion 21 in the main body 12 (see FIG. 1). A gap is formed between the overhang portion 32 and both the guides 21*a* of the base portion 21, and the gap forms a portion of a feed path of the paper P.

The rotary member 33 is supported on the shaft 30 so as to be rotated around the shaft 30. The rotary member 33 includes a first arm 34 extending from the shaft 30 toward the front oblique upper side thereof and a second arm 35 extending from the shaft 30 toward the rear oblique lower side thereof, and the length of the first arm 34 is larger than that of the second arm 35. One end of the first arm 34 and one end of the second arm 35 are connected to each other in a support portion of the shaft 30, and the angle between the first arm 34 and the second arm 35 is always constantly maintained.

A roller 34*a*, which rotates around an axial line extending in the left-and-right direction, is supported so as to pivot on the front end (upper end) of the first arm 34, and the roller 34*a* is inserted into a concave portion 32*a* provided in the overhang portion 32. Accordingly, the first arm 34 can be engaged with the paper P fed at the downstream side of the inclined surfaces 29*a* of the gate members 29 on the feed path of the paper P. Meanwhile, an engagement pin 35*a* extending in the left-and-right direction is provided on the front end (lower end) of the second arm 35, and the other end 31*b* of the torsion coil spring 31 is in contact with the engagement pin 35*a*.

The rotary member 33 is rotated and displaced between a first position (position shown in FIG. 2) in which the other end 31*b* of the torsion coil spring 31 is in contact with the engagement pin 35*a*, that is, the energizing force of the torsion coil spring 31 is maintained at the same level as the energizing force at the time of collision, and a second position (position shown in FIG. 8) in which the first arm 34 is engaged with the paper P fed along the guides 21*a* so as to be rotated from the first position around the shaft 30 in the counterclockwise direction, and the engagement pin 35*a* of the second arm 35 pushes the other end 31*b* of the torsion coil spring 31 (by applying the pressing force to the other end 31*b*), such that the energizing force of the torsion coil spring 31 is larger than the energizing force at the time of collision.

Next, the operation of the auto paper feed device 13 having the above-described configuration will be described with reference to FIGS. 4 to 8.

Figure 4:
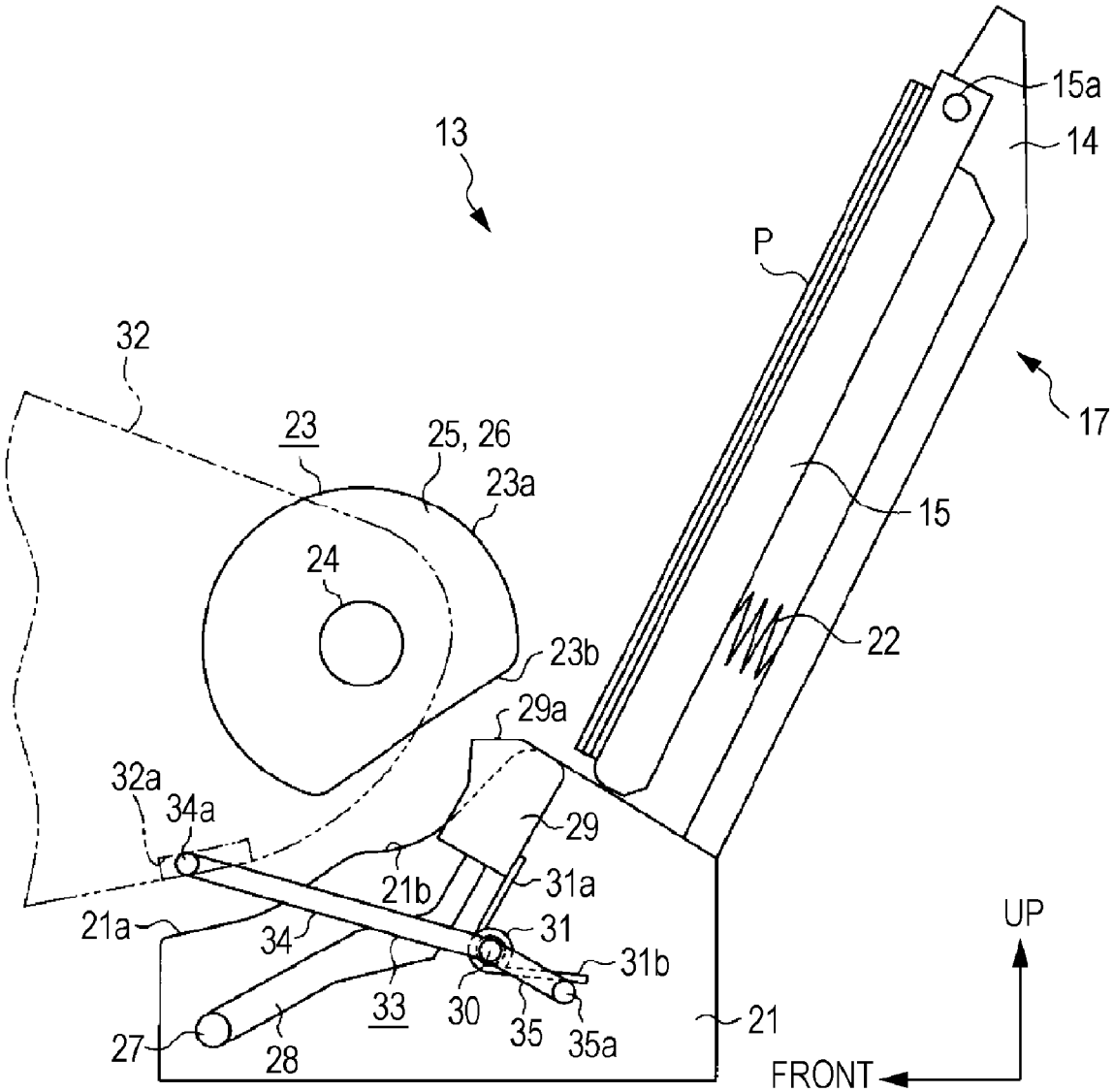
FIG. 4 is a schematic side view showing a reset state in the auto feed device according to the embodiment of the invention.

In a reset state shown in FIG. 4, the separation portions 26 of the paper feed roller 23 face the gate members 29 in the vicinity of the center of the flat surface 23*b*, and the hopper 15 is located at the retreated position separated from the delivery portion 25 of the paper feed roller 23. In addition, the rotary member 33 is located at the first position.

Figure 5:
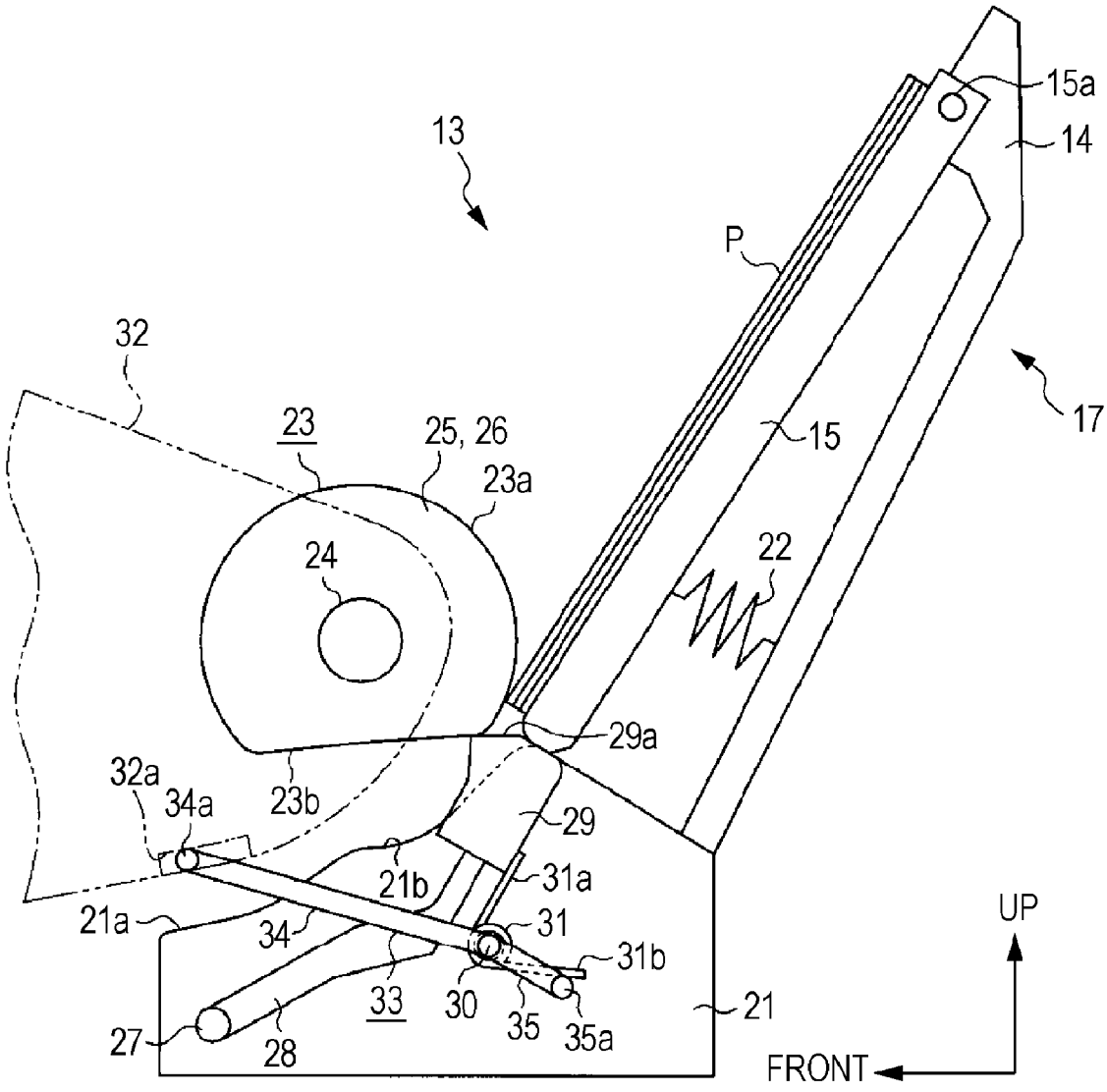
FIG. 5 is a schematic side view showing a state when paper is delivered, in the auto feed device according to the embodiment of the invention.

When the rotation of the rotary shaft 24 is started and the paper feed roller 23 is rotated in the clockwise direction of FIG. 4, as shown in FIG. 5, the separation portions 26 of the paper feed roller 23 are brought into contact with the gate members 29. When the separation portions 26 are brought into contact with the gate members 29, the hopper 15 is moved from the retreated position to the paper feed position and the uppermost sheet of paper P is brought into contact with the circumferential surface 23*a* of the delivery portion 25. When the paper feed roller 23 is continuously rotated, the front end of the uppermost sheet of paper P delivered by the delivery portion 25 collides with the inclined surfaces 29*a* of the gate members 29.

Figure 6:
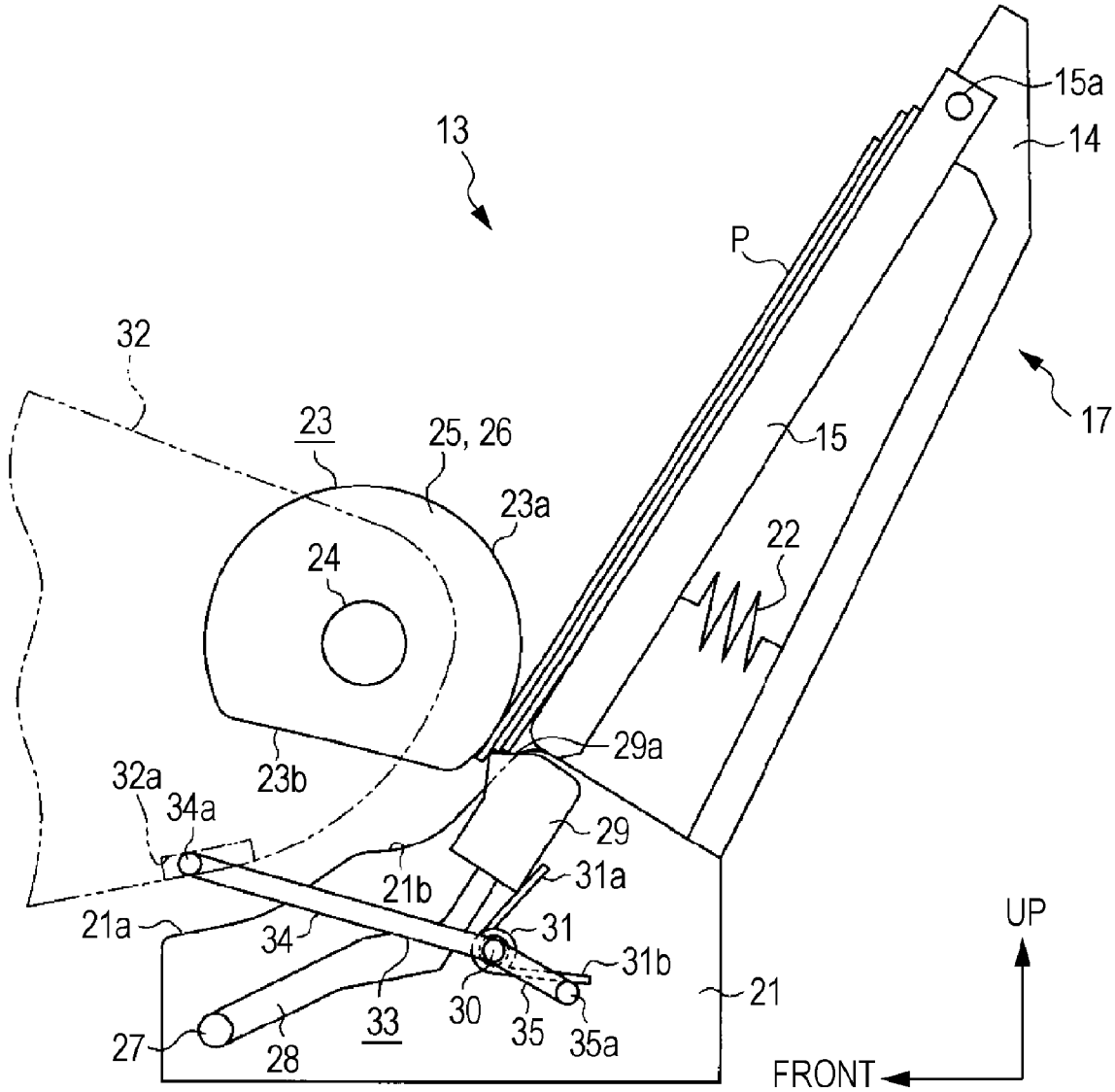
FIG. 6 is a schematic side view showing a state when paper is separated, in the auto feed device according to the embodiment of the invention.

Then, as shown in FIG. 6, the gate members 29 are moved against the energizing force of the torsion coil spring 31 in a direction (clockwise direction of FIG. 6) separated them from the circumferential surface 23*a* of the separation portions 26, a gap is formed through which only the uppermost sheet of paper P can pass between the circumferential surface 23*a* of the separation portions 26 and the gate members 29, and the front end of the uppermost sheet of paper P passes through this gap. At this time, the underlying sheet of paper P is being pushed so as to be delivered together with the uppermost sheet of paper P by the friction force generated between the sheets of paper P but the underlying sheet of paper P is prevented from being fed due to collision with the inclined surfaces 29*a* of the gate members 29 and is separated from the uppermost sheet of paper P.

Figure 7:
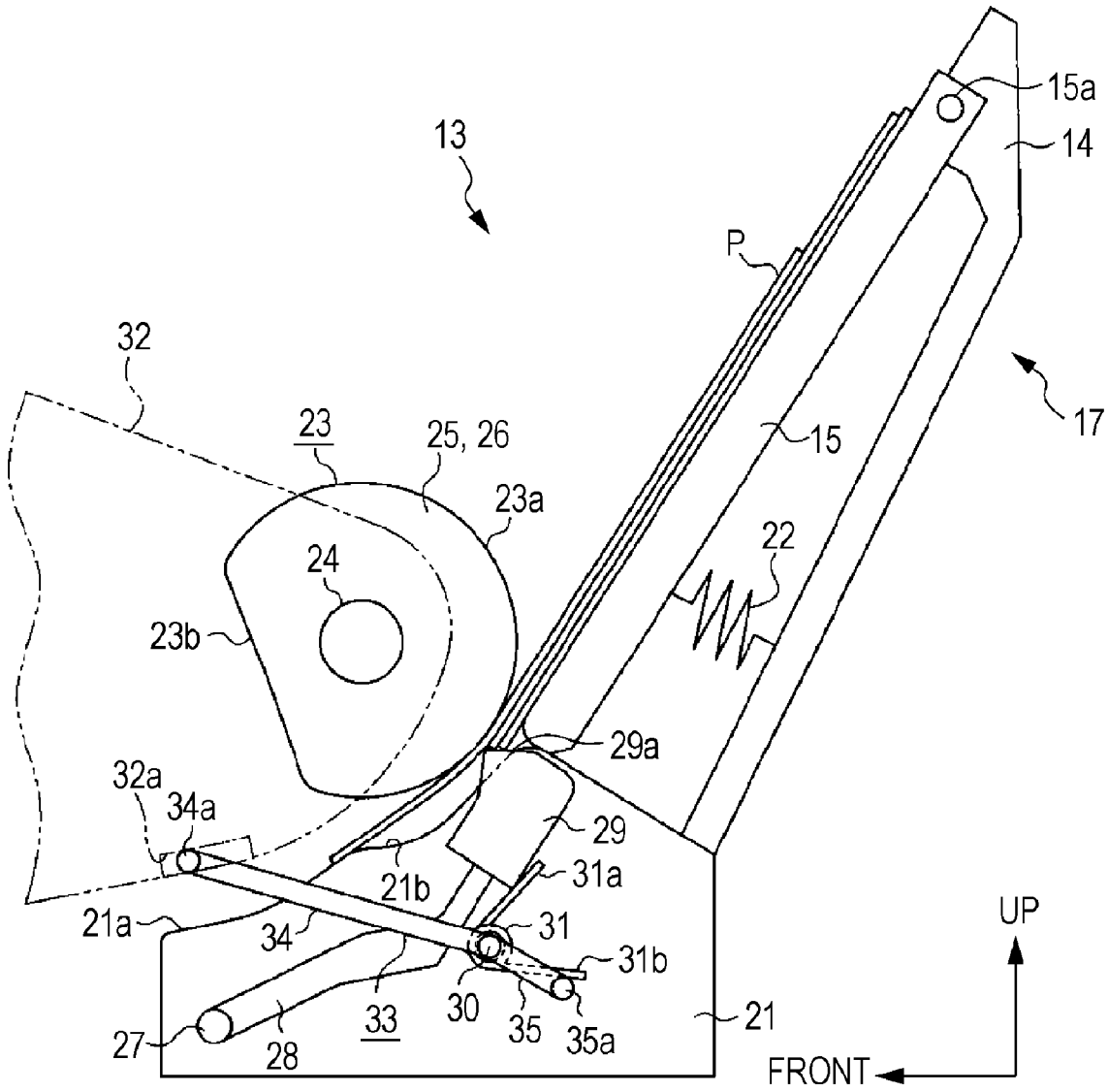
FIG. 7 is a schematic side view showing a state in the midway of feeding paper in the auto feed device according to the embodiment of the invention.

When the paper feed roller 23 is continuously rotated, the front end of the uppermost sheet of paper P passing through the gap between the circumferential surface 23*a* of the separation portions 26 and the gate members 29 reaches the bank 21*b* of the base portion 21, as shown in FIG. 7. When the paper feed roller 23 is rotated, the front end of the uppermost sheet of paper P is engaged with the first arm 34 so as to press the first arm 34 forward, as shown in FIG. 8.

Figure 8:
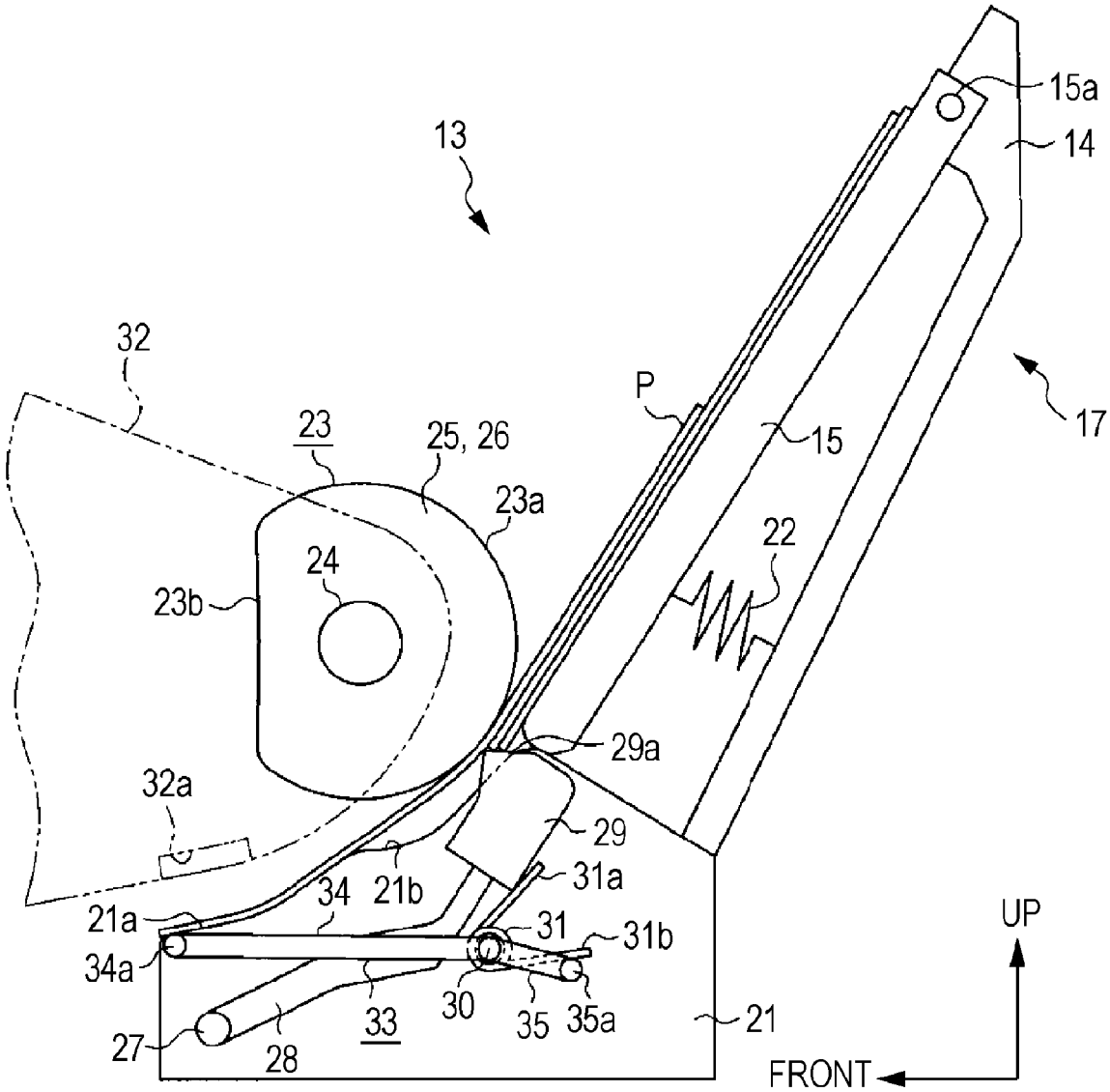
FIG. 8 is a schematic side view showing a state, in which a rotary member is rotated and displaced at a second position, in the auto feed device according to the embodiment of the invention.

Then, since the front end of the uppermost sheet of paper P presses the first arm 34 against the energizing force of the torsion coil spring 31 and thus the rotary member 33 is rotated around the shaft 30 in the counterclockwise direction of FIG. 8 so as to be rotated and displaced from the first position to the second position. Thus, the engagement pin 35*a* of the second arm 35 pushes the other end 31*b* of the torsion coil spring 31 toward one end 31*a* such that the energizing force of the torsion coil spring 31 becomes larger than the energizing force at the time of collision. That is, the pressing force of one end 31*a* of the torsion coil spring 31 which presses the gate members 29 toward the paper feed roller 23 is increased.

Since it is even harder for the paper P underlying the uppermost sheet of paper P to get over the inclined surface 29*a* and thus the underlying sheet of paper P is properly prevented from being fed (double fed) simultaneously with the uppermost sheet of paper P. At this time, since the rotary member 33 is in contact with the uppermost sheet of paper P in the roller 34*a* of the first arm 34, the roller 34*a* is rotated by the feed of the uppermost sheet of paper P. Accordingly, since the frictional resistance, which is applied from the rotary member 33 in which the uppermost sheet of paper P is located at the second position when the uppermost sheet of paper P is fed, is reduced, the smooth feeding state of the uppermost sheet of paper P is maintained.

Thereafter, the uppermost sheet of paper P is fed to the recording head 19 by the feed force based on the rotation of the paper feed roller 23. When the uppermost sheet of paper P is fed to the recording head 19 such that the uppermost sheet of paper P and the roller 34*a* of the first arm 34 are separated from each other, the rotary member 33 is rotated and displaced from the second position to the first position by the energizing force of the torsion coil spring 31.

According to the above-described embodiment, the following effects can be obtained.

(1) In the auto feed device 13, when the uppermost sheet of paper P is fed from the sheets of paper P loaded in the stacked state, the rotary member 33 is displaced from the first position to the second position by the engagement between the uppermost sheet of paper P and the first arm 34 after the front end of the uppermost sheet of paper P passes through the gap between the circumferential surface 23*a* of the separation portions 26 of the paper feed roller 23 and the gate members 29. Thus, the engagement pin 35*a* of the second arm 35 pushes the other end 31*b* of the torsion coil spring 31 toward the one end 31*a* such that the energizing force of the torsion coil spring 31 becomes larger than the energizing force at the time of collision. Therefore, since the pressing force of the gate members 29 which press the paper feed roller 23 is increased, it is hard for the paper P underlying the uppermost sheet of paper P to get over the inclined surfaces 29*a* of the gate members 29. Thus, it is possible to easily separate the uppermost sheet of paper P and the paper P underlying the uppermost sheet of paper P. As a result, when the uppermost sheet of paper P is fed, it is possible to efficiently suppress the double feed of the paper P underlying the uppermost sheet of paper P.

(2) In the auto feed device 13, it is possible to suppress the double feed of the paper P underlying the uppermost sheet of paper P when the uppermost sheet of paper P is fed by the rotary member 33 which is rotated and displaced between the first position and the second position. Accordingly, it is possible to reduce the space necessary for displacing the rotary member between the first position and the second position, compared with the case where the rotary member 33 is changed to the displacement member linearly reciprocated between the first position and the second position.

(3) The auto feed device 13 includes the first arm 34 which is engaged with the paper P at the downstream side of the inclined surface 29*a* on the feed path of the paper P when the rotary member 33 is located at the first position and the second arm 35 for applying the pressing force to the torsion coil spring 31 in the direction in which the energizing force of the torsion coil spring 31 is increased, when the rotary member 33 is located at the second position. Thus, when the front end of the uppermost sheet of paper P is engaged with the first arm 34, it is possible to rotate and displace the rotary member 33 from the first position to the second position against the energizing force of the torsion coil spring 31 using the feeding force of the uppermost sheet of paper P so as to increase the energizing force of the torsion coil spring 31. In contrast, when the uppermost sheet of paper P is not engaged with the first arm 34, it is possible to rotate and displace the rotary member 33 from the second position to the first position by the energizing force of the torsion coil spring 31.

(4) In the auto paper feed device 13, the roller 34*a* which rotates by the feeding of the uppermost sheet of paper P is provided in the contact portion of the first arm 34 with the uppermost sheet of paper P. Thus, when the uppermost sheet of paper P is fed, the first arm 34 and the uppermost sheet of paper P are engaged with each other and the rotary member 33 is rotated and displaced from the first position to the second position. Accordingly, when the first arm 34 is brought into contact with the uppermost sheet of paper P, it is possible to reduce the frictional resistance force applied from the first arm 34 to the uppermost sheet of paper P. That is, even when the first arm 34 is brought into contact with the uppermost sheet of paper P, since the roller 34*a* is rotated by the feed of the uppermost sheet of paper P, it is possible to eliminate the inhibition of the feed of the uppermost sheet of paper P and to maintain the smooth feed state of the uppermost sheet of paper P.

(5) When the rotary member 33 is located at the first position, since the concave portion 32*a* into which the roller 34*a* of the first arm 34 is inserted is provided in the overhang portion 32, it is possible to increase the rotational range of the rotary member 33 by the depth of the concave portion 32*a*.

MODIFIED EXAMPLE

In addition, the above-described embodiment may be changed as follows.

The roller 34*a* of the first arm 34 may be omitted. In this case, the contact portion of the first arm 34 with the uppermost sheet of paper P preferably has a shape in which they easily slide on the uppermost sheet of paper P (for example, a drum shape, a spherical shape or a flat shape).

Instead of the torsion coil spring 31, a leaf spring or a coil spring may be used a gate energizing member.

A sensor for detecting that the front end of the uppermost sheet of paper P passes through the gap between the circumferential surface 23*a* of the separation portions 26 of the paper feed roller 23 and the gate members 29 and a driving unit for rotating and displacing the rotary member 33 between the first position and the second position may be provided, and the driving unit may be configured to rotate and displace the rotary member 33 between the first position and the second position based on the signal output from the sensor. In this case, the first arm 34 of the rotary member 33 is omitted.

The concave portion 32*a* provided in the overhang portion 32 may be omitted.

Instead of the paper feed roller 23, an endless transfer belt which circumferentially moves may be employed, and the paper feed operation may be performed by the circumferential movement of the endless transfer belt.

In the paper feed roller 23, the separation portions 26 may be omitted. In this case, the gate members 29 need to be configured to be in contact with the delivery portion 25.

In the paper feed roller 23, the delivery portion 25 and the separation portions 26 may be separately configured. In this case, the delivery portion 25 and the separation portions 26 need to be configured to be synchronously rotated by the rotation and the driving of the rotary shaft 24.

The number of rotary members 33 may be two according to the number of gate members 29. Alternatively, even when the number of gate members 29 is three or more, the rotary members 33 may be provided so as to individually correspond to the gate members 29.

The paper feed roller 23 may be configured in a circular shape in side view.

In the paper feed roller 23, the separation portion 26 may be disposed on the center thereof in the axial direction and the delivery portions 25 may be disposed on both sides of the separation portion 26 in the axial direction.

The movement of the gate members 29 is not limited to the rotation, and, for example, reciprocal movement using a slider with a coil spring interposed therebetween may be used.

Instead of the paper P, a plastic film may be used as a sheet member.

What is claimed is:

1. A feed device comprising:

a loading unit configured to receive a plurality of sheet members loaded in a stacked state;

a delivery member configured to perform a feed operation in a state in which a contact surface thereof is in contact with the uppermost sheet member of the sheet members loaded on the loading unit and is configured to deliver the uppermost sheet member in a feed direction using the frictional force with the uppermost sheet member as the feeding force;

a gate member which is configured to move in a direction to and from the contact surface of the delivery member and has an inclined surface that is inclined in the feed direction, the front end of the uppermost sheet member colliding with the inclined surface in response to being delivered by the delivery member;

a gate energizing member configured to energize the gate member in a direction approaching the contact surface of the delivery member; and a rotary member having a first arm which is configured to engage with the sheet member at a position which is downstream from the loading unit and a second arm which is in contact with the gate energizing member, the rotary member configured to rotate between a first position and a second position, causing the second arm to vary the level of energizing force applied to the gate member by the gate energizing member, such that the rotary member causes the gate energizing member to apply a first level of energizing force when the rotary member is located in the first position and to apply a second level of energizing force when the rotary member is located in the second position, wherein the second level of energizing force is greater than the first level of energizing force, wherein the gate member is configured to move away from the delivery member against the first level of energizing force of the gate energizing member to form a gap in response to the uppermost sheet member of the plurality of sheet members colliding with the inclined surface of the gate member, the gap formed thereby being large enough for only the uppermost sheet member of the plurality of sheet members to pass between the delivery member and the gate member, and wherein the rotary member is displaced from the first position to the second position by the first arm engaging with the sheet member at the position which is downstream from the gap.

2. The feed device according to claim 1, wherein the first arm is engaged with the sheet member at a downstream side of the inclined surface on a feed path of the sheet member at the first position and wherein the second arm applies pressing force to the gate energizing member in a direction, in which the energizing force of the gate energizing member is increased at the second position.

3. The feed device according to claim 2, wherein a roller which rotates by the feed of the sheet member is provided in a contact portion of the first arm with the sheet member.

4. A recording device comprising:

the feed device according to claim 1; and a recording unit which performs a recording process with respect to the sheet member fed by the feed device.

* * * * *